United States Patent [19]

Hunter

[11] Patent Number: 4,699,199

[45] Date of Patent: Oct. 13, 1987

[54] AUTOMATED MOLD MAKING SYSTEM

[75] Inventor: William A. Hunter, Inverness, Ill.

[73] Assignee: Hunter Automated Machinery Corporation, Schaumburg, Ill.

[21] Appl. No.: 853,770

[22] Filed: Apr. 18, 1986

Related U.S. Application Data

[63] Continuation-in-part of Ser. No. 794,591, Nov. 4, 1985, abandoned, which is a continuation of Ser. No. 527,411, Aug. 29, 1983, abandoned.

[51] Int. Cl.[4] ..... B22C 15/28; B22C 17/04; B22C 17/06

[52] U.S. Cl. ..... 164/180; 164/187; 164/188; 164/190; 164/191; 164/225

[58] Field of Search ..... 164/200–202, 164/180, 181, 322, 187, 207, 313, 401, 37, 38, 40, 44, 190, 191, 225, 188

[56] References Cited

U.S. PATENT DOCUMENTS

| | | | |
|---|---|---|---|
| 1,403,809 | 1/1922 | Nicholls | 164/180 |
| 2,908,950 | 10/1959 | Miller et al. | 164/217 |
| 3,406,738 | 10/1968 | Hunter | 164/182 |
| 3,424,229 | 1/1969 | Gunnergaard-Poulsen | 164/340 |
| 3,744,549 | 7/1973 | Buhler | 164/160.1 |

*Primary Examiner*—Nicholas P. Godici
*Assistant Examiner*—Samuel M. Heinrich
*Attorney, Agent, or Firm*—Leydig, Voit & Mayer

[57] ABSTRACT

A system for making foundry molds comprising the combination of a platen assembly including a platen having a top surface for supporting a mold pattern, and a ram for raising and lowering the platen in response to a controllable pressurized fluid; a mold flask supported above the platen so that upward movement of the platen positions the mold pattern thereon within the flask and closes the bottom of the flask so that the flask can be filled with sand; a sand hopper located adjacent the mold flask, and a sand magazine mounted for lateral movement between a retracted position below the sand hopper where the magazine can be loaded with sand from the hopper, and an advanced position above the mold flask for filling the cavity defined by the flask and the platen assembly with sand from the magazine; a squeeze head located adjacent the mold flask and mounted for lateral movement so that the squeeze head can be positioned over the mold flask, after the flask has been filled with sand and the sand magazine has been returned to the sand hopper, for closing the top of the flask and the flask is squeezed between the platen assembly and the squeeze head; and mold removal means located adjacent the mold flask and mounted for lateral movement so that the mold removal means can be advanced to grip a mold formed by squeezing the sand in the flask, and then retracted to transfer the finished mold from the flask to a mold platform or a mold stack on the platform.

11 Claims, 32 Drawing Figures

AUTOMATED MOLD MAKING SYSTEM

CROSS REFERENCE TO RELATED APPLICATIONS

This application is a continuation-in-part of my copending U.S. patent application Ser. No. 794,591 filed Nov. 4, 1985, abandoned, for "Automated Mold Masking System", which in turn is a continuation of my now-abandoned U.S. patent application Ser. No. 527,411 filed Aug. 29, 1983 for "Automated Mold Making System".

BACKGROUND OF THE INVENTION

The present invention relates to automated systems for forming green sand molds for use in foundries. Prior art systems for this purpose are described in Hunter U.S. Pat. Nos. 3,406,738 for "Automatic Matchplate Molding Machine"; Hunter 3,506,058 for "Method of Matchplate Moulding"; Hunter 3,520,348 for "Fill Carriages for Automatic Matchplate Moulding Machines"; and Hunter 4,156,450 for "Foundry Machine and Method and Foundry Mold Made Thereby".

SUMMARY OF THE INVENTION

It is a primary object of the present invention to provide an automated mold-making system which is capable of operating at extremely high production rates, e.g., producing over 1,000 molds per hour.

It is another important object of this invention to provide such an automated mold-making system which produces molds with a high degree of reliability and accuracy, so that the mold reject rate is extremely low. In this connection, a related object of the invention is to provide such a system which virtually eliminates mold breakage.

A further object of this invention is to provide an improved automated mold-making system which prefills the mold flask rapidly but at a low pressure, thereby extending the pattern life and virtually eliminating pattern breakage or deflection while at the same time providing a high rate of productivity.

Yet another object of this invention is to provide such an improved automated mold-making system which is extremely versatile in that it can make cope and/or drag molds, mold stacks with cavities either above or below the parting, molds with half patterns, and stacked cope and drag molds.

A still further object of one particular aspect of the invention is to provide such an improved automated mold-making system which achieves high production rates while using only a single mold flask and without any need to index the flask through successive work stations.

Other objects and advantages of the invention will be apparent from the following detailed description and the accompanying drawings.

In accordance with the present invention, the foregoing objectives are realized by a system for making foundry molds comprising the combination of a platen assembly including a platen having a top surface for supporting a mold pattern, and a ram for raising and lowering the platen in response to a controllable pressurized fluid; a mold flask supported above the platen so that upward movement of the platen positions the mold pattern thereon within the flask and closes the bottom of the flask so that the flask can be filled with sand; a sand hopper located adjacent the mold flask, and a sand magazine mounted for lateral movement between a retracted position below the sand hopper where the magazine can be loaded with sand from the hopper, and an advanced position above the mold flask for filling the cavity defined by the flask and the platen assembly with sand from the magazine; a squeeze head located adjacent the mold flask and mounted for lateral movement so that the squeeze head can be positioned over the mold flask, after the flask has been filled with sand and the sand magazine has been returned to the sand hopper, for closing the top of the flask and forming the top surface of a mold when the sand in the flask is squeezed between the platen assembly and the squeeze head; and mold removal means located adjacent the mold flask and mounted for lateral movement so that the mold removal means can be advanced to grip a mold formed by squeezing the sand in the flask, and then retracted to transfer the finished mold from the flask to a mold platform or a mold stack on the platform.

While the invention will be described in connections with certain preferred embodiments, it will be understood that it is not intended to limit the invention to those particular embodiments. On the contrary, it is intended to cover all alternatives, modifications and equivalent arrangements as may be included within the spirit and scope of the invention as defined by the appended claims.

DESCRIPTION OF THE PREFERRED EMBODIMENT

Figure 1:
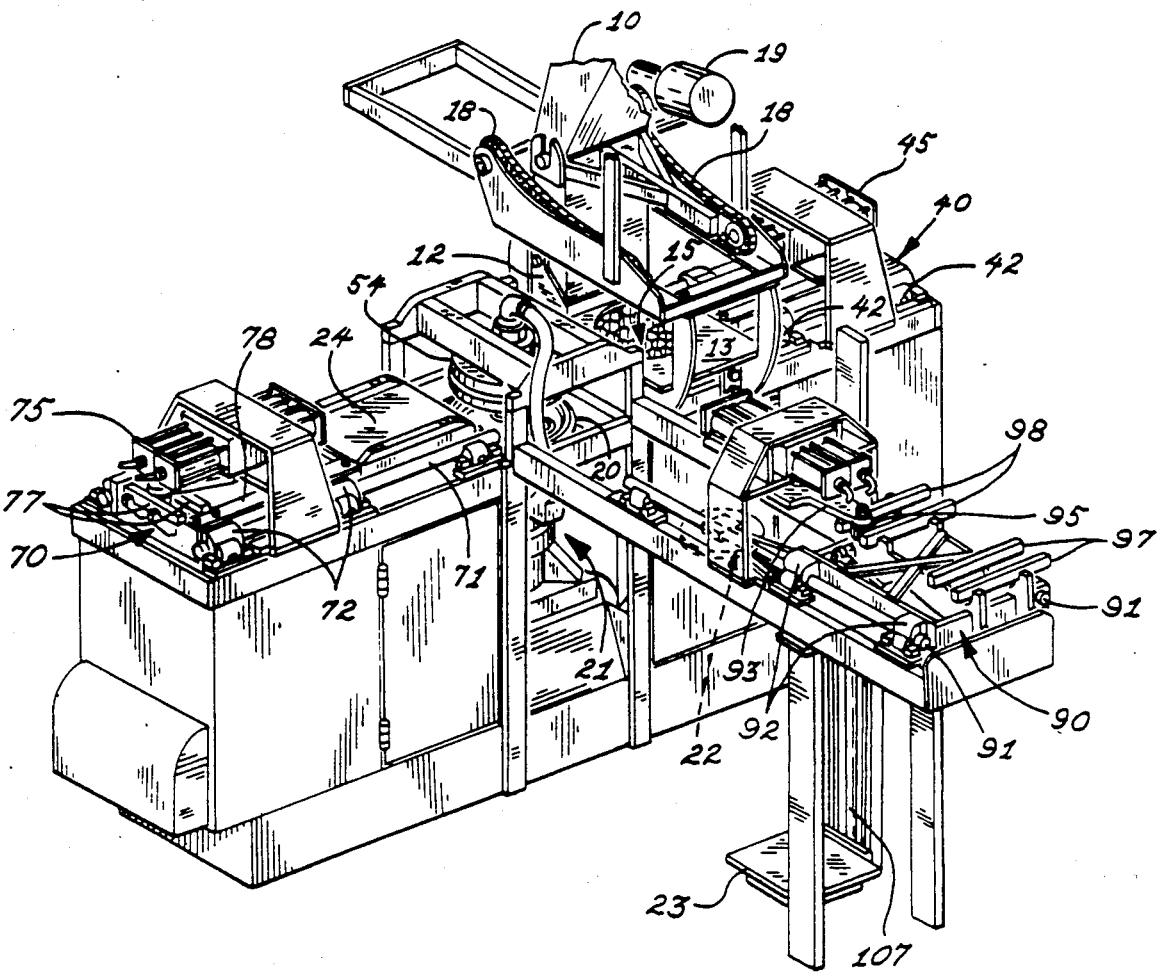
FIG. 1 is a perspective view of an automated mold-making machine embodying the present invention.

Turning now to the drawings and referring first to FIG. 1, foundry sand enters the machine of FIG. 1 through a sand-loading hopper 10 from any conventional feeding device such as a conveyor. As is well known in the foundary art, the sand is normally premixed with a certain amount of bentonite or other binder to bind the sand particles together during the formation of a mold therefrom. The hopper 10 includes a shuttle 12 which moves back and forth across a stationary slide plate 13 having a circular opening 14 (see FIG. 4) in the center thereof to provide access to a sand magazine 15 (see FIG. 3) positioned directly under the opening 14. As the shuttle 12 passes over the opening 14, it fills the magazine 15 to capacity. At the end of each stroke of the shuttle 12, it rests on a solid portion of the plate 13 to close the shuttle exit and prevent any further discharge of sand from the shuttle.

Figure 3:
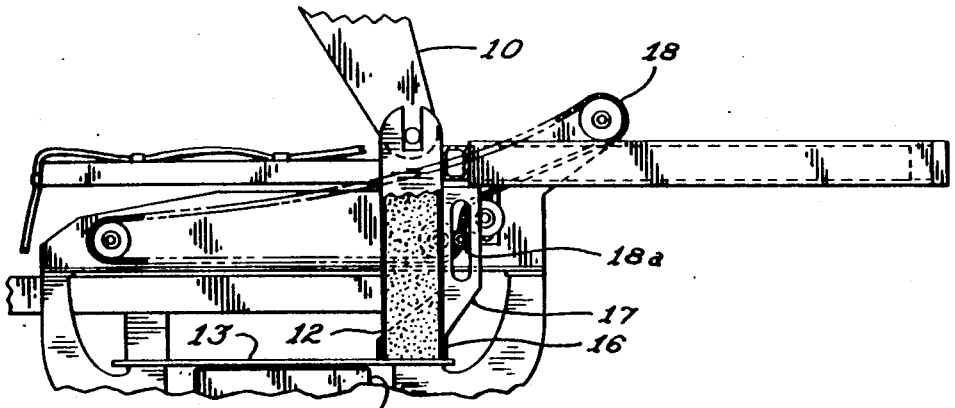
FIG. 3 is an enlarged end elevation of the sand feeding mechanism at the top of the machine of FIG. 1, with portions thereof broken away to show the internal structure.

To drive the shuttle 12 back and forth across the plate 13, the lower end of the shuttle is surrounded by a rim 16 which extends upwardly at opposite ends thereof to form a pair of slotted flanges 17 projecting beyond the side wall of the shuttle (see FIG. 3). The vertically elongated slots in the flanges 17 receive a pair of lugs 18*a* carried by a pair of drive chains 18 driven by a reversible electric motor 19. The motor 19 is driven in one direction to traverse the shuttle 12 across the plate 13 in one direction, and is then reversed (after a suitable dwell internal) to traverse the shuttle in the opposite direction. A pivoting connection between the top of the shuttle 12 and the lower end of the hopper 10 permits the lower end of the hopper to follow the shuttle 12 during its traversing movement.

In addition to the sand-loading station which includes the hopper 10 and its shuttle 12, the illustrative system includes a mold-forming station having a mold flask 20 and a platen assembly 21 directly between the flask, and a mold-stacking station containing a reciprocable vacuum head 22 for transferring finished molds from the flask 20 to a stacking platform 23. Within the mold-forming station, the flask 20 and the platen assembly 21 move only vertically, while the region directly above the flask 20 is successively accessed by lateral movements of the sand magazine 15, a squeeze head 24, and the vacuum head 22. Each of these latter three elements is mounted for reciprocating movement along a horizontal path extending radially outwardly from the flask 20 and at 90° intervals around the circumference of the flask. As will be described in detail below, in each operating cycle the sand magazine 15 is fills the flask 20 with sand, the platen assembly 21 compresses the sand in the flask against the squeeze head 24, and the vacuum head 22 picks up the finished mold and transfers it to the stacking platform 23.

Figures 4, 5:
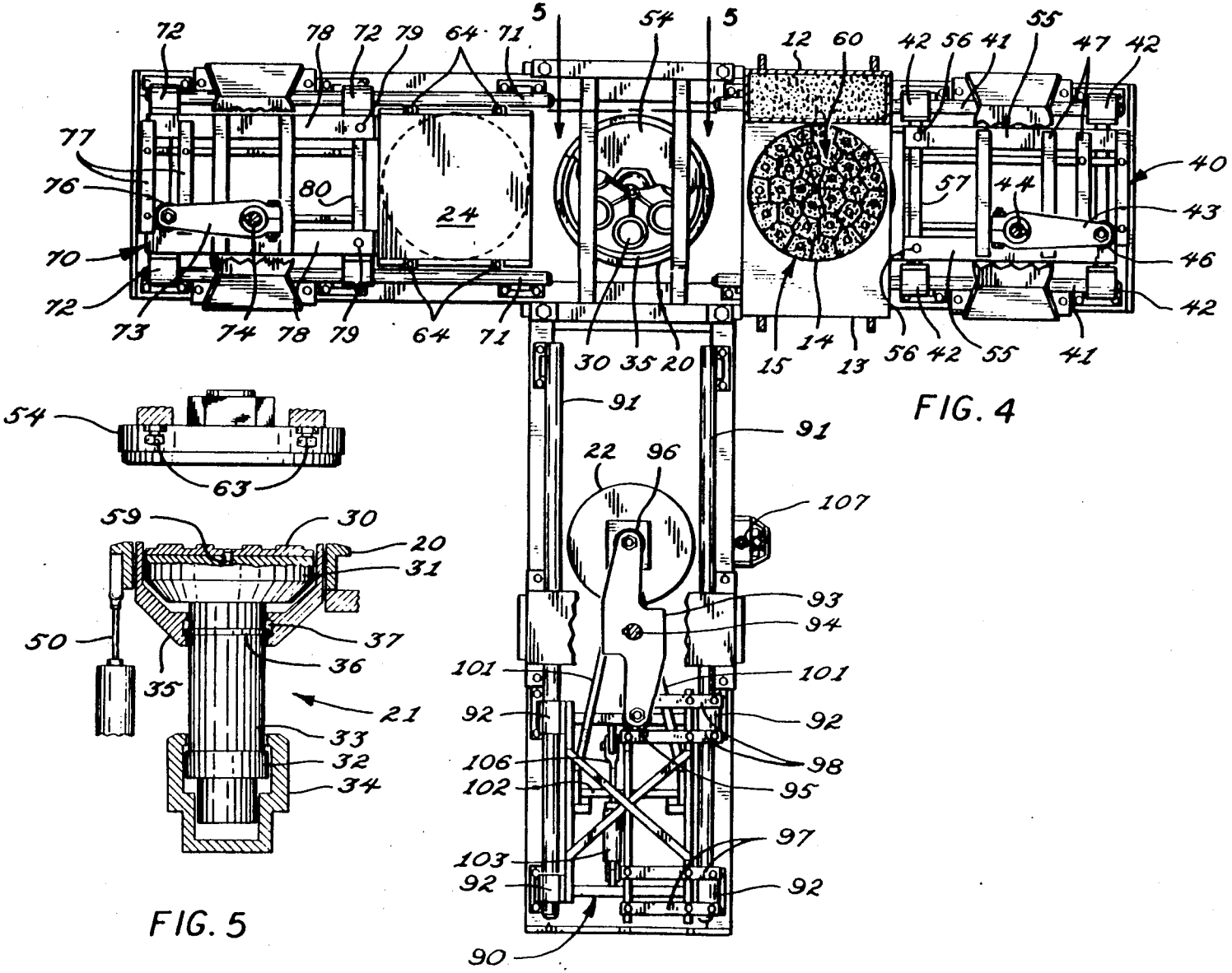
FIG. 4 is a top view of the system illustrated in FIG. 1 in a first stage of operation (with the sand magazine, the squeeze head and the vacuum head all retracted from the mold-forming station), with portions thereof broken away to show the underlying structure.
FIG. 5 is an enlarged side elevation of the mold forming station, taken generally along line 5—5 in FIG. 4, with portions thereof shown in section.

Before starting the manufacture of any given mold, the desired mold pattern 30 is fastened to the top of a platen 31 included in the platen assembly 21 (see FIGS. 4 and 5). The pattern 30 defines the desired interior configuration of the mold and, therefore, the configuration of the article to be cast in the mold. The vertical position of the platen 31 and the pattern 30 are controlled by the hydraulic pressure on opposite sides of a flange 32 projecting laterally from a vertical ram 33 which carries the platen 31 on the upper end thereof. The bottom of the ram telescopes into a cylinder 34 which extends upwardly around the flange 32 to contain the pressurized hydraulic fluid.

The ram 33 also carries a strip ring 35 which extends upwardly between the platen 31 and the flask 20 in sliding contact with the inside walls of the flask 20 and the outside walls of the platen 31. The strip ring 35 can also be raised and lowered relative to the platen 31 and the ram 33, within a limited range of movement, by controlling the hydraulic pressure on opposite sides of a flange 36 extending outwardly from the upper portion of the ram 33 into an annular cavity 37 within the strip ring. The height of this annular cavity 37 and the thickness of the flange 36 determine the available range of vertical movement of the strip ring 35 relative to the ram 33 and the platen 31.

FIGS. 1, 2, 4 and 5 show the mold making system in its idle condition. It can be seen that the sand magazine 15, the squeeze head 24, and the vacuum head 22 are all in their retracted positions. This is the condition of the system while the desired pattern 30 is being mounted on the platen 31. The sand magazine 15 has already been loaded with sand by a previous traversing movement of the shuttle 12.

Before the flask 20 is filled with sand, the ram 33 is lowered to position the pattern 30 on the platen 31 at the desired elevation within the flask, with the pattern 30 and the strip ring 35 closing the bottom of the empty flask (see FIGS. 7–10). The strip ring 35 is lowered to its lowermost position relative to the ram 33 as illustrated in FIGS. 7–10, so that the top surface of the ring 35 is flush with the adjacent surfaces of the pattern 30.

Figure 2:
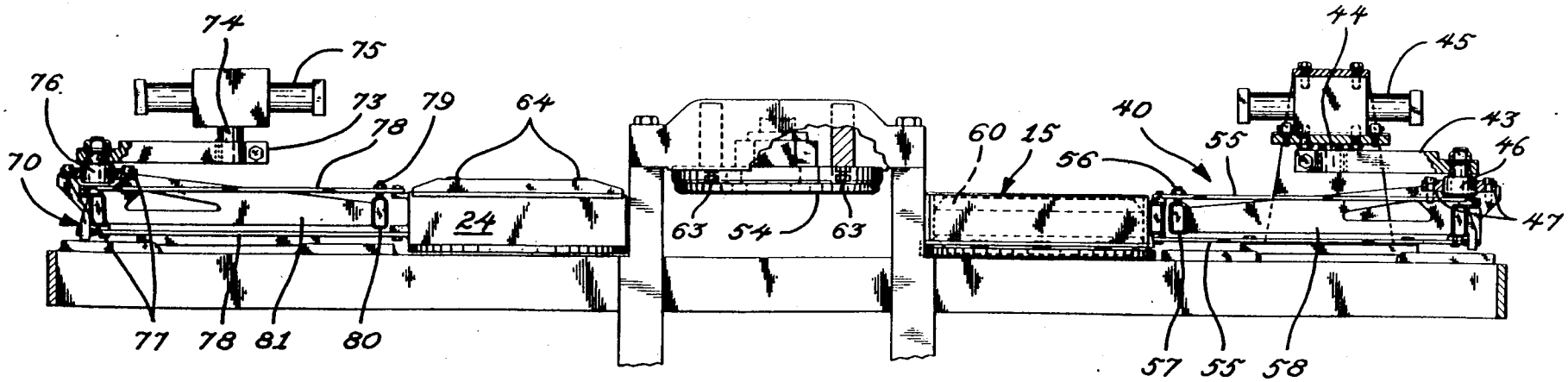
FIG. 2 is an enlarged side elevation of the upper portion of the machine of FIG. 1, with portions thereof broken away to show the internal structure.
Figures 6, 7, 8, 9, 10:
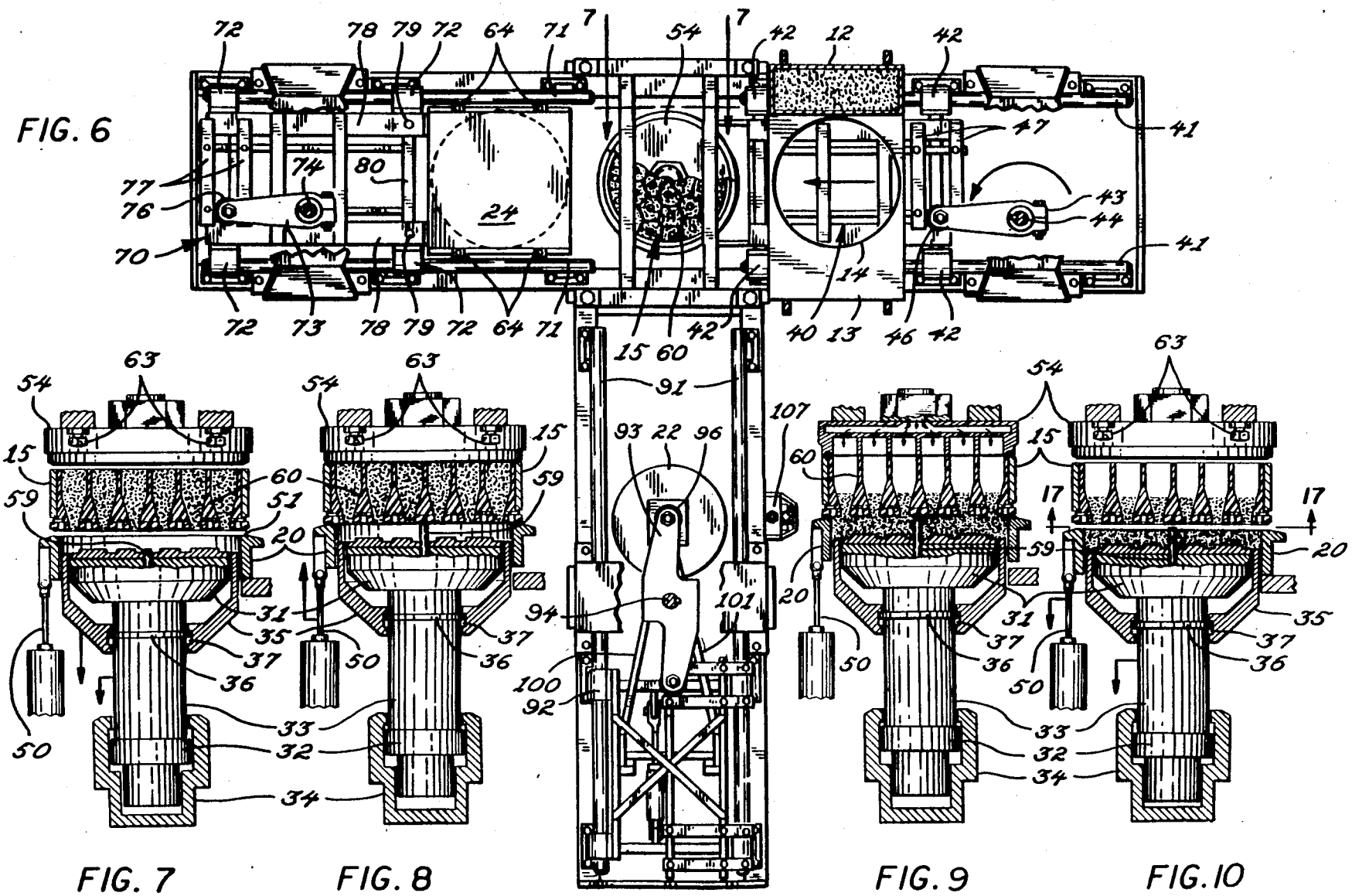
FIG. 6 is the same top plan view shown in FIG. 4 but with the system in a second stage of operation (with the sand magazine advanced into the mold-forming station)
FIGS. 7, 8, 9 and 10 are enlarged side elevations taken generally along the line 7—7 in FIG. 6, with portions thereof in section, showing different steps of the operating cycle carried out while the system is in the operating stage illustrated in FIG. 6.

To permit the sand magazine 15 to be moved back and forth between its retracted position beneath the slide plate 13 (as shown in FIG. 4) and its advanced position in the mold forming station (as shown in FIG. 6), the magazine is cantilevered from the end of a carriage 40 (see FIGS. 2 and 4). This carriage 40 is mounted for a sliding movement back and forth along a pair of parallel rails 41 via four bearing blocks 42 at the four corners of the carriage (FIG. 4).

To drive the carriage along the rails 41, a rotatable crank 43 is fastened at one end to the carriage 40 and at its other end to a drive shaft 44 driven by a motor 45 (FIG. 2). The connection between the crank 43 and the carriage 40 permits the end of the crank to slide back and forth across the width of the carriage 40 as the crank is rotated, thereby converting the rotary movement of the crank to reciprocating linear movement of the carriage 40. In the illustrative system, the conversion is effected by a roller 46 journaled on the end of the crank 43 and riding between a pair of parallel bars 47. Rotation of the crank 43 through 180°, from the position shown in FIG. 4 to the position shown in FIG. 6, advances the carriage 40 and the sand magazine 15 from the fully retracted position to the fully advanced position. Rotation of the crank in the opposite direction, of course, returns the carriage 40 and the magazine 15 to the retracted position. As can be seen from FIGS. 4 and 6, the stroke of the reciprocating movement of the sand magazine 15 is only slightly longer than the diameter of the magazine, and thus the magazine can be quickly advanced or retracted by the simple crank drive.

After the sand magazine 15 has been advanced into the mold-forming station, the flask 20 is raised by a pair of hydraulic piston rods 50 (one shown in FIGS. 7–10) connected to opposite sides of the flask 20. The flask is raised until (1) a land 51 on the top of the flask engages a gasket 52 (see FIG. 19) on the underside of the sand magazine 15 to provide a good seal between the top of the flask and the bottom of the sand magazine, and (2) the sand magazine is lifted into tight engagement with a gasket 53 on the underside of an air manifold 54. The mounting of the sand magazine 15 on its carriage 40 permits such upward movement of the magazine 15 in response to the upward pressure exerted thereon by the flask 20 and its hydraulic piston rods 50. Thus, as shown most clearly in FIGS. 2 and 4, the magazine 15 is fastened to the ends of four steel straps 55 which are rigidly fastened to the outboard end of the carriage 40. At the inboard end of the carriage 40, however, the straps are fastened only to the magazine 15, thereby permitting the magazine 15 to be raised. Lifting of the magazine 15 merely bends the straps 55. Downward movement of the magazine 15 is blocked by a pair of adjustable screws 56 in the straps 55 abutting a transverse beam 57 at the inboard end of the carriage 40. A pair of ribs 58 connect the beam 57 to the outboard end of the carriage.

During the upward movement of the flask 20, a sprue pin 59 is also extended upwardly through the pattern 30 by an internal hydraulic or pneumatic cylinder **59*a* (not shown). This sprue pin 59 defines the size and shape of the sprue opening to be formed in the center of the mold. In its fully advanced position, illustrated n FIGS. 8 and 9, the top of the sprue pin 59 is brought into seating engagement with a pin seat formed in the center of the lower surface of the sand magazine 15**.

When the mold flask 20, the platen assembly 21, and the sprue pin 59 are in their final raised positions beneath the sand magazine 15 (see FIG. 8), they define an annular cavity which is predetermined to have the proper size and shape for receiving the proper amount of "prefill" sand for forming the desired mold. The prefill is then effected by supplying pressurized air to the top of the sand contained in the sand magazine 15, thereby causing the sand to flow downwardly through a sand manifold 60 within the sand magazine, into the prefill cavity within the flask 20. The pressurized air is supplied from a compressed air tank through a control valve and multiple ports in the air manifold 54 located directly above the sand magazine 15 in the mold forming station. The pressurized air is distributed uniformly throughout the sand magazine by the internal structure of the air manifold, the lower portion of which forms multiple cavities matching those in the sand manifold 60 (see FIG. 9).

From the air manifold 54, the pressurized air flows downwardly through the sand magazine 15 and the manifold 60 therein, and then exits through a plurality of air vent holes formed in the bottom plate 61 of the sand magazine 15 (see FIG. 19); these vent holes are preferably covered with fine screens (not shown) to block the entry of sand. This downward flow of air through the sand magazine carries the sand downwardly through the manifold 60 into the flask 20, thereby filling the prefill cavity with sand as illustrated in FIG. 9.

Figure 17:
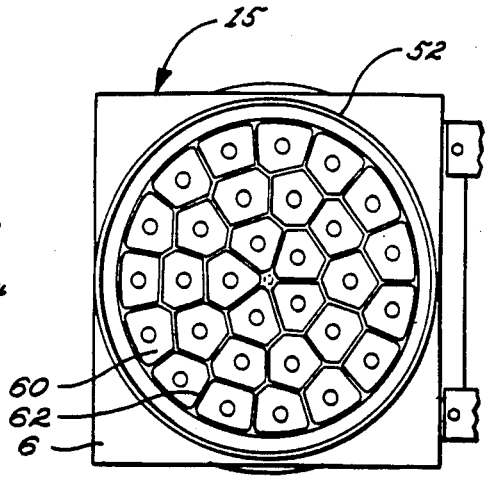
FIG. 17 is an enlarged bottom plan view of the sand magazine, taken generally along the line 17—17 in FIG. 10.
Figure 18:
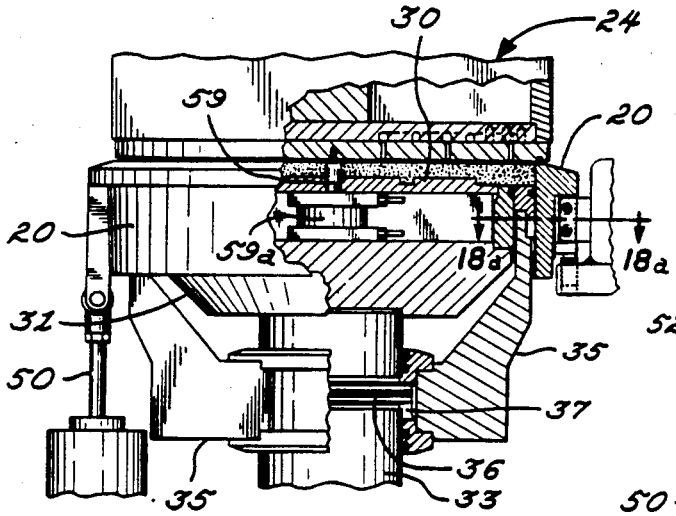
FIG. 18 is an enlarged side elevation, partially in section, of the platen assembly and squeeze head in the positions illustrated in FIG. 13.
Figure 19:
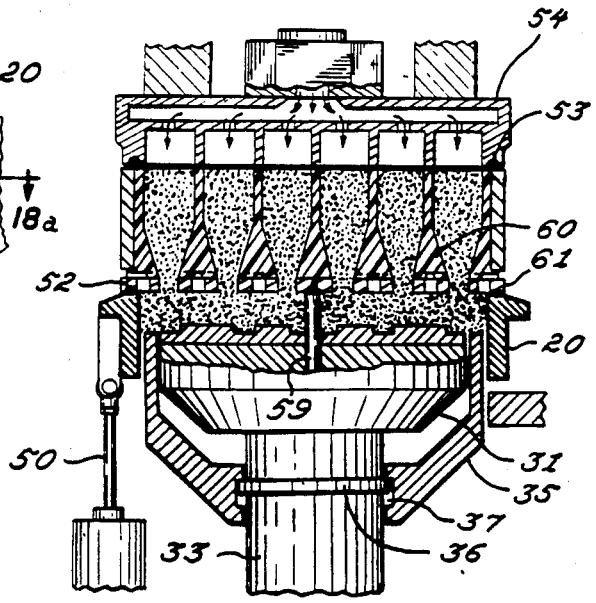
FIG. 19 is an enlarged vertical section showing the platen assembly and the sand magazine in the positions illustrated in FIG. 9.
Figure 18A:
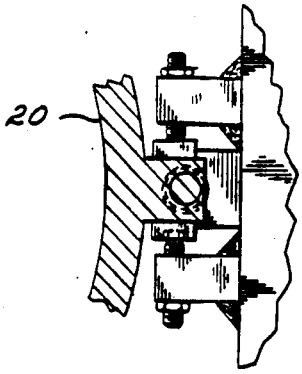
FIG. 18*a* is an enlarged section taken along the line 18*a*—18*a* in FIG. 18.
Figure 20:
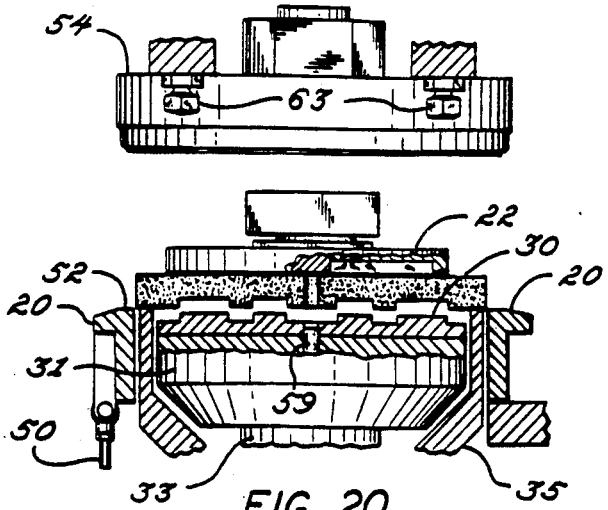
FIG. 20 is an enlarged side elevation, partially in section, of the vacuum head and platen assembly in the positions illustrated in FIG. 25.

As can be seen most clearly in FIGS. 17 and 19, the sand manifold 60 is a relatively thick molded part which forms numerous funnel-shaped cavities 62 spaced relatively uniformly over substantially the entire area circumscribed by the side walls of the sand magazine 15. These funnel-shaped cavities 62 permit the sand to flow freely from the magazine 15 into the prefill cavity when the pressurized air is supplied to the top of the sand magazine, while at the same time promoting packing of the sand in the lower portions of the manifold cavities 62 after the air flow has been cut off. This natural "packing" tendency of the foundry sand is sufficient to hold the sand within the manifold 60 so there is no need to close the open ends of the holes along the bottom surface of the manifold 60 when the sand is not being expelled therefrom.

After the prefill cavity within the flask 20 has been filled with sand, the flask 20 and the entire platen assembly 21 are lowered to the position illustrated in FIG. 10. This allows the sand magazine 15 to return to its normal vertical position where it is spaced from the air manifold 54, and also provides the necessary clearance beneath the magazine 15 to permit the magazine to be withdrawn from the mold-forming station and returned to its retracted position (illustrated in FIG. 4). As the sand magazine 15 is withdrawn, the squeeze head 24 is advanced into the mold forming station as illustrated in FIG. 12.

The squeeze head 24 forms a rigid structure against which the prefill sand can be squeezed by further upward movement of the platen assembly 21 via the ram 33. The bottom surface of the squeeze head 24 also determines the shape of the top surface of the mold. In most cases, this top surface of the mold will be perfectly flat, but if desired, the lower surface of the squeeze head 24 can be patterned to provide cavities of a desired configuration in the top surface of the mold. The bottom of the squeeze head 24 also carries a sprue pin seat identical to the seat provided on the lower surface of the sand magazine 15.

A rigid backup support for the squeeze head 24 is provided by four studs 63 depending from the machine frame on opposite sides of the air manifold 54. When the squeeze head 24 is lifted slightly by the upward movement of the flask 20, the studs 63 engage mating plates 64 on the top of the squeeze head 24, as shown in FIG. 13.

Figures 11, 12, 13, 14, 15:
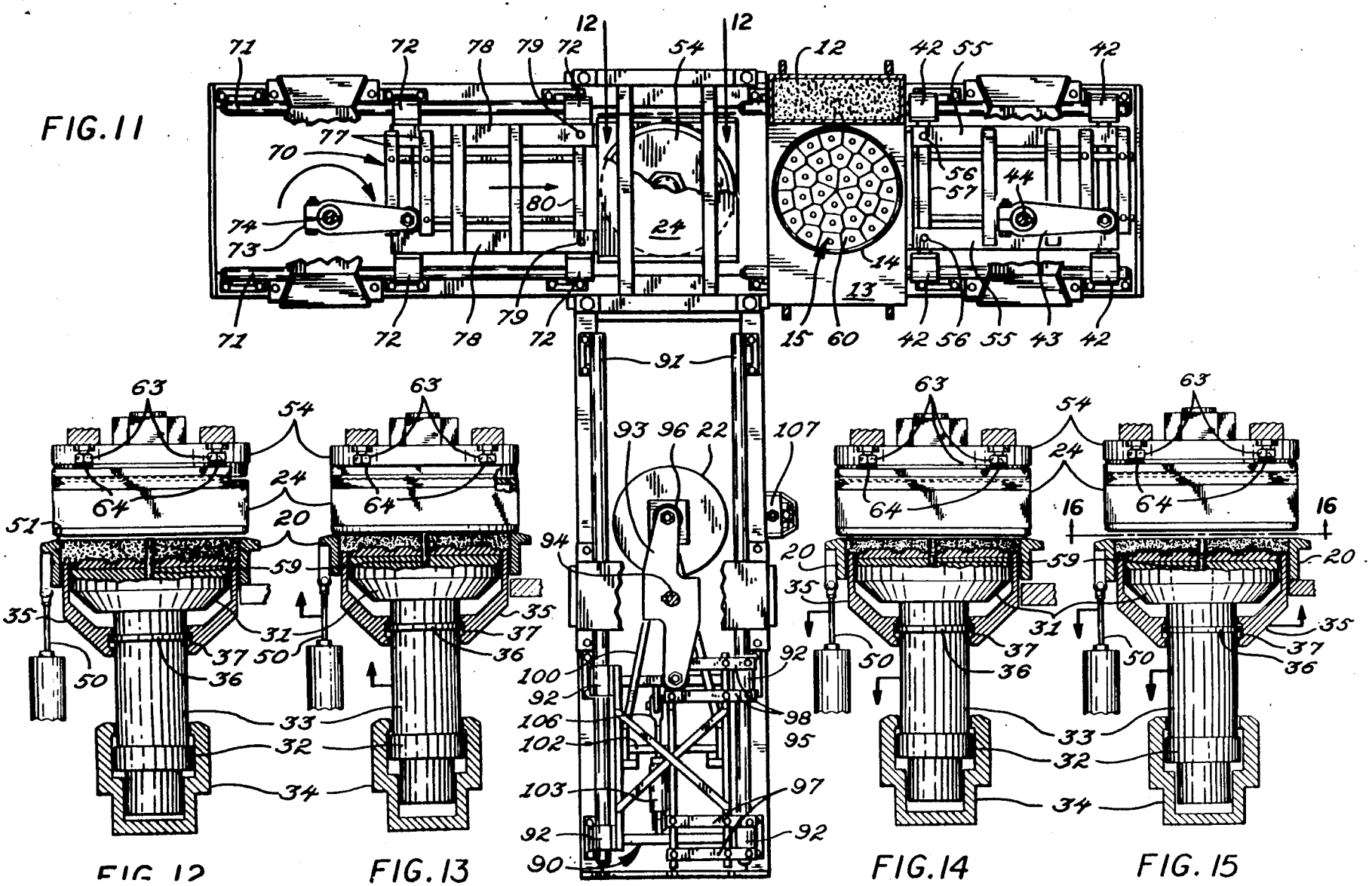
FIG. 11 is the same top plan view shown in FIG. 4, but with the system in a third stage of operation (with the sand magazine retracted and the squeeze head advanced into the mold forming station)
FIGS. 12, 13, 14 and 15 are enlarged side elevations taken generally along the line 12—12 in FIG. 11, with portions thereof in section, showing different steps of the operating cycle carried out while the system is in the operating stage illustrated in FIG. 11.
Figure 16:
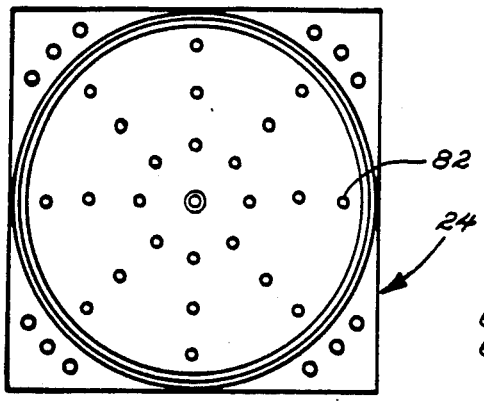
FIG. 16 is an enlarged bottom plan view of the vacuum head, taken generally along the line 16—16 in FIG. 15.

To permit the squeeze head 24 to be moved back and forth between its retracted position (as shown in FIGS. 2, 4 and 6) and its advanced position in the mold forming station (as shown in FIG. 11), the squeeze head is cantilevered from the end of a carriage 70 (see FIGS. 2 and 11). This carriage 70 is mounted for a sliding movement back and forth along a pair of parallel rails 71 via four bearing blocks 72 at the four corners of the carriage. To drive the carriage along the rails 71, a rotatable crank 73 is fastened at one end to the carriage 70 and at its other end to a drive shaft 74 driven by a motor 75 (FIG. 2). The connection between the crank 73 and the carriage 70 permits the end of the crank to slide back and forth across the width of the carriage 70 as the crank is rotated, thereby converting the rotary movement of the crank to reciprocating linear movement of the carriage 70. In the illustrative system, the conversion is effected by a roller 76 journaled on the end of the crank 73 and riding between a pair of parallel bars 77. Rotation of the crank 73 through 180°, from the position shown in FIGS. 2, 4 and 6 to the position shown in FIG. 11 advances the carriage 70 and the squeeze head 24 from its retracted position to its advanced position. Rotation of the crank in the opposite direction, of course, returns the carriage 70 and the squeeze head 24 to the retracted position. As can be seen from FIGS. 6 and 1, the stroke of the reciprocating movement of the squeeze head 24 is only slightly longer than the diameter of the squeeze head, and thus the squeeze head can be quickly advanced or retracted by the simple crank drive.

As soon as the squeeze head 24 has been positioned over the flask 20 in the mold-forming station, the flask is once again elevated. This time the flask 20 is raised until the land on the top surface thereof engages the bottom of the squeeze head 24 and raises the squeeze head into engagement with the studs 63, as illustrated in FIG. 13. As in the case of the sand magazine 15, the squeeze head 24 is mounted on its carriage 70 in a way that permits upward movement of the squeeze head 24 in response to the upward pressure exerted thereon by the flask 20 and its hydraulic piston rods 50. Thus, the squeeze head 24 is fastened to the ends of four steel straps 78 which are rigidly fastened to the outboard end of the carriage 70. The inboard ends of the straps 78 are fastened only to the squeeze head 24, so that upward movement of the squeeze head merely bends the straps. Downward movement of the squeeze head 24 is blocked by a pair of adjustable screws 79 in the straps 78 abutting a transverse beam 80 connected to the outboard end of the carriage 70 by a pair of ribs 81.

After the upward movement of the flask 20 and the squeeze head 24 has stopped, upward movement of the platen assembly 21 is continued to squeeze the sand in the flask 20 against the squeeze head 24. To permit air to escape from the prefill cavity as the sand therein is squeezed, multiple holes 82 are formed in the bottom wall of the squeeze head. As is well known in the foundry industry, this squeezing of the prefill sand causes it to compact into a coherent structure with sharply defined mold cavities. This is the final mold ready for use in the casting of molten metal. The final thickness of the mold is determined by the volume of sand in the prefill cavity, and the hardness of the mold is determined by the pressure settling for the ram 33 which applies the squeezing force.

Figures 21, 22:
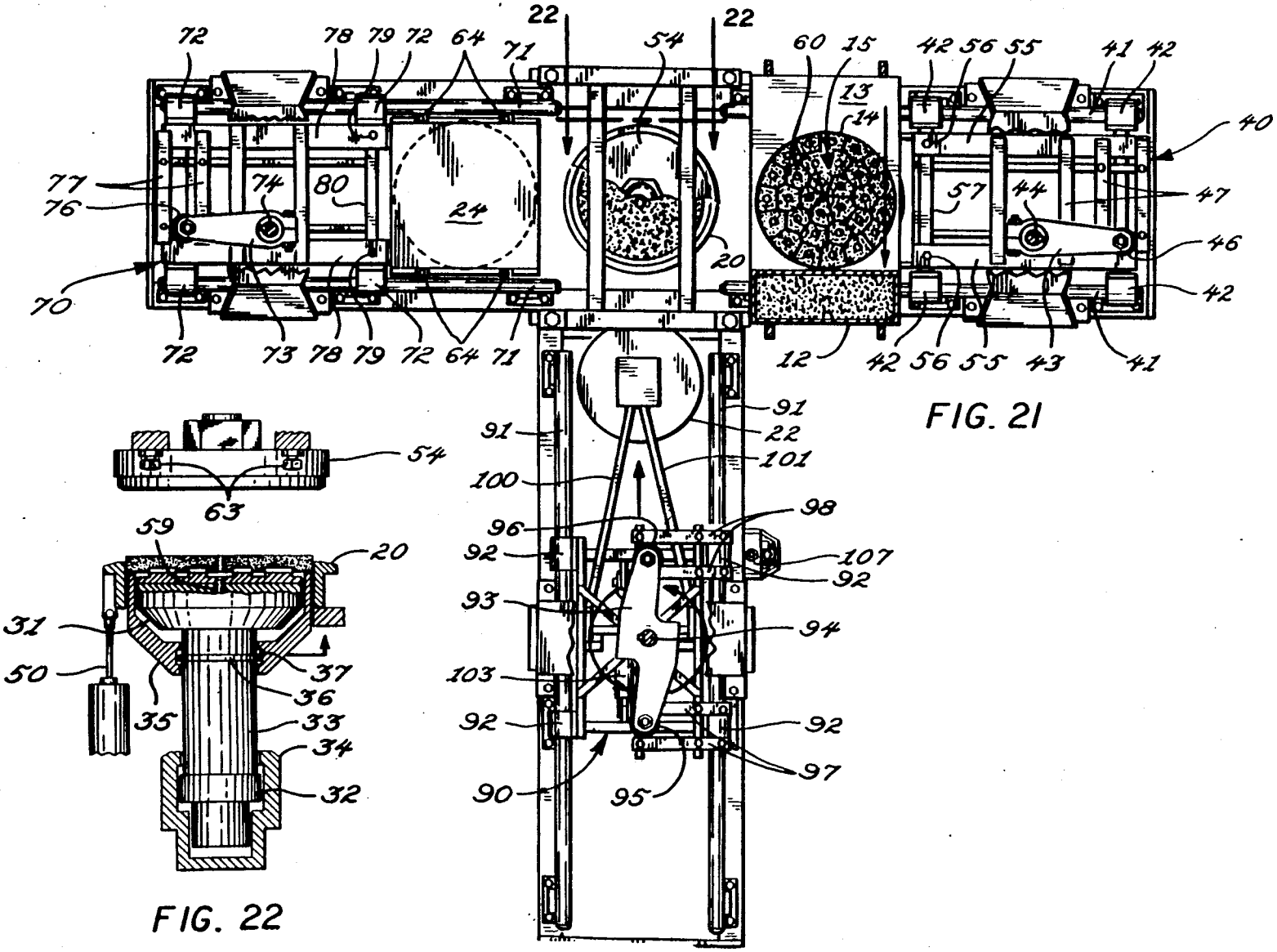
FIG. 21 is the same top plan view shown in FIG. 4 but with the system in a fourth stage of operation; with the sand magazine and the squeeze head retracted, and the vacuum head in a partially advanced position.
FIG. 22 is an enlarged side elevation taken generally along the line 22—22 in FIG. 21, with portions thereof in section.

Following the squeezing operation, the flask 20 and the platen assembly 21 are lowered to the position illustrated in FIG. 14, and the sprue pin 52 is retracted from the mold. This draws the top surface of the mold away from the squeeze head 24, as illustrated in FIG. 14. The downward movement of the ram 33 is then continued while maintaining the strip ring 35 at a constant elevation to draw the pattern 30 cleanly away from the bottom of the mold, as illustrated in FIG. 15. Finally, the downward movement of the ram 33 is stopped while the upward movement of the strip ring 35 is continued to break the mold loose from the walls of the flask 20, as illustrated in FIG. 22. In the meantime, the squeeze head 24 is withdrawn to its retracted position (see FIGS. 21 and 22) so that the space above the flask 20 is ready to receive the vacuum head 22 which picks up the finished mold and transfers it to the stacking platform 23.

Figures 23, 24, 25, 26, 27:
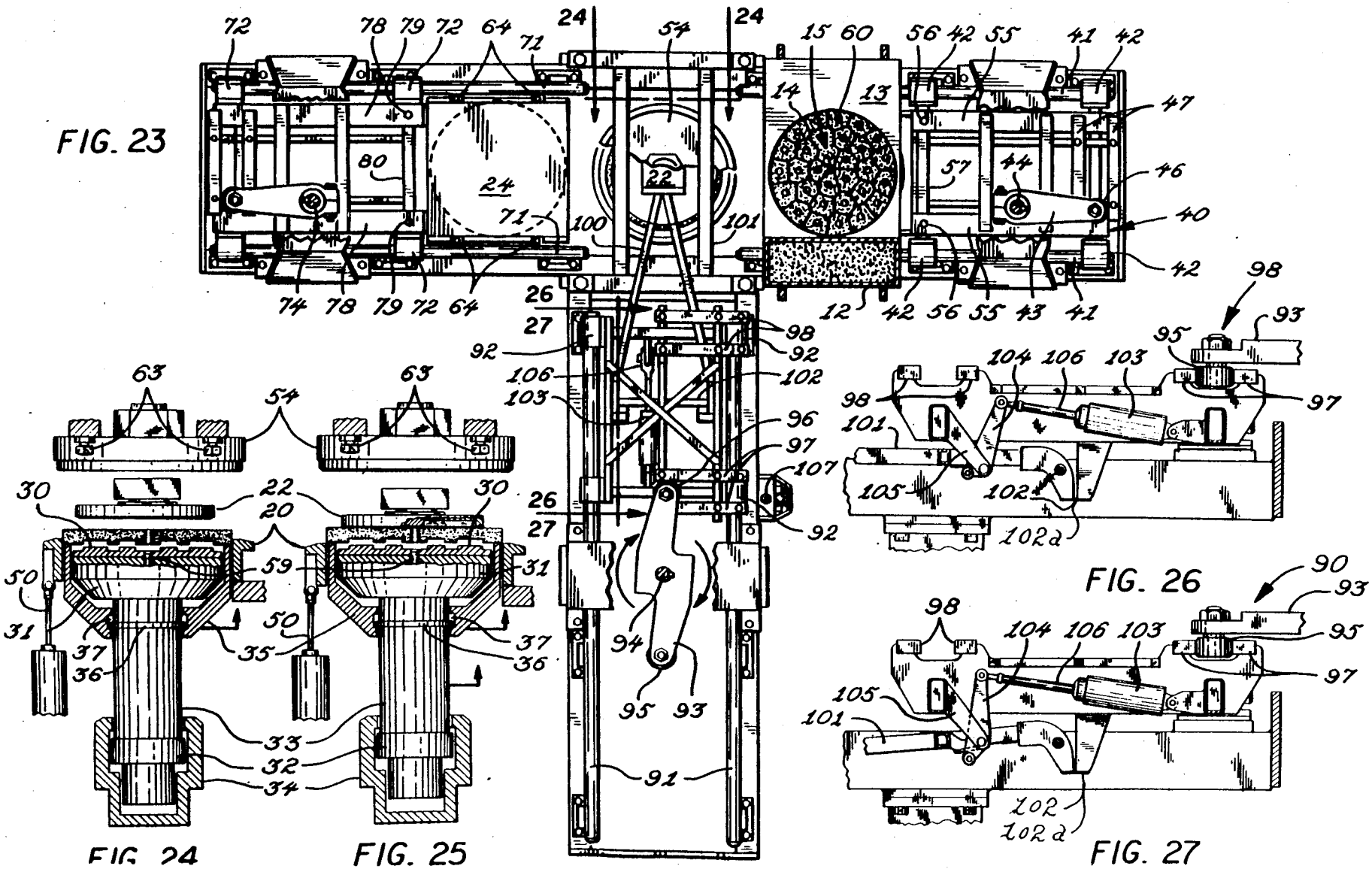
FIG. 23 is the same top plan view shown in FIG. 4 but with the system in a fifth stage of operation (with the sand magazine and squeeze head retracted, and the vacuum head in its fully advanced position in the mold forming station)
FIGS. 24 and 25 are enlarged side elevations taken generally along the line 24—24 in FIG. 23, with portions thereof in section, showing different steps of the operating cycle carried out while the system is in the operating stage illustrates in FIG. 23.
FIGS. 26 and 27 are side elevations taken generally along the line 26, 27—26, 27 in FIG. 23, showing the elevation control mechanism for the vacuum head in two different stages of operation.

To permit the vacuum head 22 to be moved back and forth between its retracted position over the stacking platform 23 (shown in FIG. 11) and its advanced position in the mold forming station (as shown in FIG. 23), the vacuum head is cantilevered from the end of a carriage 90. This carriage 90 is mounted for a sliding movement back and forth along a pair of parallel rails 91 via four bearing blocks 92 at the four corners of the carriage. To drive the carriage along the rails 91, a rotatable crank 93 is fastened to a drive shaft 94 driven by a motor (not shown), and opposite ends of the crank 93 are alternately connected to the carriage 90. The connection between the crank 93 and the carriage 90 permits alternate ends of the crank to slide across the width of the carriage 90 as the crank is rotated through 360°, thereby converting the rotary movement of the crank to reciprocating linear movement of the carriage 90. In the illustrative system, the conversion is effected by rollers 95 and 96 journaled on opposite ends of the crank 93 so that as the crank is rotated, the rollers 95 and 96 alternately ride between two pairs of parallel bars 97 and 98 on the carriage 90. Rotation of the crank 93 through 360° successively advances the carriage 90 and the vacuum head 22 from the fully retracted position shown in FIG. 11 to the midway position shown in FIG. 21, and then on to the fully advanced position shown in FIG. 23. Rotation of the crank in the opposite direction, of course, returns the carriage 90 and the vacuum head 22 to the fully retracted position.

As will be described in detail below, the vacuum head is also mounted for limited vertical movement. FIG. 24 shows the vacuum head 22 in its fully advanced and raised position, directly over the flask 20, and FIG. 25 shows the vacuum head 22 after it has been lowered and the strip ring 35 raised to bring the mold and the vacuum head 22 into engagement with each other. Both the upward movement of the strip ring 35 and the downward movement of the vacuum head 22 are executed slowly so that the mold is brought into gentle contact with the vacuum head 22. The time required for this operation, however, is extremely short because the distances traversed by the vertical movements of the strip ring and the vacuum head are very short.

FIGS. 26 and 27 illustrate the mechanism for effecting the vertical movement of the vacuum head 22. Thus, the vacuum head is cantilevered from the carriage 90 by a pair of arms 100 and 101 that are secured to the carriage by a pair of hinge plates 102 and 102*a*, which are bolted to the arms 100 and 101 and the carriage 90. The hinge plates 102 and 102*a* are the pivotal members for the two arms 100 and 101. During advancing and retracting movement of the vacuum head 22 and its carriage 90, these arms 100 and 101 are held in a straight horizontal position by a hydraulic cylinder 103 connected to the arms by a lever 104 pivoted on a bracket 105 depending from the carriage 90. When it is desired to lower the vacuum head, while it is in its advanced position in the mold forming station, the piston rod 106 of the hydraulic cylinder 103 is advanced to the position shown in FIG. 27, thereby pivoting the arms 100 and 101 downwardly to bring the vacuum head 22 into contact with the rising mold. The piston rod 106 is then retracted again, to the position illustrated in FIG. 26, to return the vacuum head 22 to its normal raised position. The vacuum head is then withdrawn from the mold forming station, while carrying the finished mold, by moving the carriage 90 to its retracted position.

Figures 28, 29, 30, 30A:
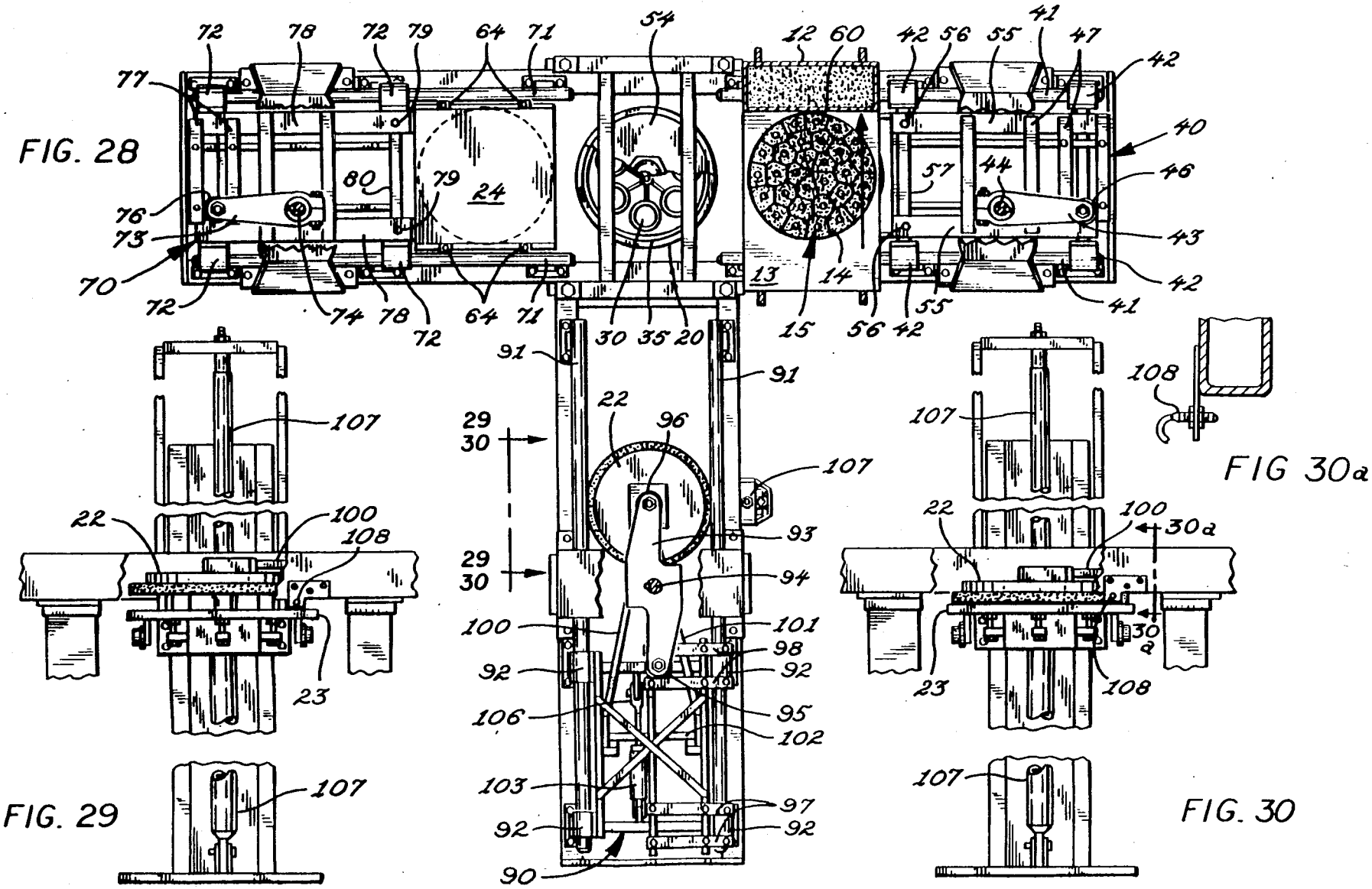
FIG. 28 is the same top plan view shown in FIG. 4 but with the system in a sixth stage of operation, (with the sand magazine, the squeeze head, and the vacuum head all in their fully retracted positions), with the vacuum head carrying a finished mold and the sand magazine loaded with sand for forming a new mold.
FIGS. 29 and 30 are enlarged side elevations taken generally along the line 29, 30—29, 30 in FIG. 28, showing the mold stacking platform in two different stages of operation.
FIG. 30A is a section taken along the line 30A—30A in FIG. 30.

When the vacuum head 22 has been fully retracted, to the position illustrated in FIGS. 4, 6 and 11, the finished mold carried by the vacuum head is deposited on the current mold stack, or directly on the stacking platform 23 in the case of the first mold in a given stack. Here again the hydraulic cylinder 103 is utilized to lower the vacuum head 22, from the position shown in FIG. 29 to the position shown in FIG. 30, to gently deposit the mold onto the stacking platform 23, or onto the top of the last mold deposited on the stack supported by the platform.

Each time an additional mold is deposited on the stacking platform 23 or on the stack of molds supported by the platform, the platform is indexed downwardly by a hydraulic cylinder 107. To control this indexing movement, an optical fiber sensor 108 senses each new mold deposited on the platform or the mold stack, then actuates the cylinder 107 to lower the platform by one mold thickness. This indexing movement of the cylinder 107 continues until the sensor 108 detects the absence of a mold in the space adjacent to the sensor. The downward movement of the cylinder 107, and thus the stacking platform 23, is then terminated so that the top of the mold stack on the platform is always at the same elevation.

I claim:

1. A system for making foundry molds comprising the combination of a platen assembly located in a molding station and including a platen having a top surface for supporting a mold pattern, and a ram for raising and lowering the platen upwardly and downwardly in the molding station in response to a controllable pressurized fluid, a mold flask supported permanently in said molding station above said platen so that upward movement of the platen positions the mold pattern thereon within the flask and closes the bottom of the flask so that the flask and the platen assembly form a mold-forming cavity that can be filled with sand, a sand hopper spaced laterally from said molding station, and a sand magazine mounted for lateral movement between a retracted position below the sand hopper where the magazine can be loaded with sand from the hopper, and an advanced position in said molding station and above the mold flask where the cavity defined by the flask and the platen assembly can be filled with sand from the magazine, a squeeze head spaced angularly from said sand magazine and mounted for lateral movement into said molding station so that the squeeze head can be positioned over the mold flask, after the flask has been filled with sand and the sand magazine has been returned to the sand hopper, for closing the top of the flask and forming the top surface of a mold when the sand in the flask is squeezed between the platen assembly and the squeeze head, means for separating said mold and said flask, and mold removal means spaced angularly from said sand magazine and from said squeeze head and mounted for lateral movement into said molding station so that the mold removal means can be advanced to grip a finished mold separated from the flask, and then retracted out of said molding station to transfer the finished mold to a mold platform or a mold stack on said platform.

2. The system of claim 1 wherein said sand magazine and said squeeze head are spaced approximately 180 degrees from one another around the circumference of said mold flask and in which said mold removal means are spaced substantially equidistantly from said magazine and said squeeze head.

3. The system of claim 1 wherein said mold removal means comprises a vacuum head mounted for lateral movement into said molding station for gripping the finished mold by vacuum.

4. The system of claim 1 wherein said means for separating said mold from said flask includes a strip ring which slides along the inside walls of said flask and the outside walls of said platen, and means for raising the strip ring relative to the platen and the flask for at least partially withdrawing a finished mold from the mold pattern and flask.

5. The system of claim 1 which includes prefilling means for supplying pressurized air to the top of the sand magazine to quickly discharge sand from the magazine into the mold flask.

6. The system of claim 5 wherein said sand magazine includes a sand manifold for distributing sand uniformly throughout the flask when sand is discharged from the magazine into the flask.

7. The system of claim 6 wherein said sand manifold comprises a plate with a multiplicity of funnel-shaped holes extending downwardly therethrough and uniformly spaced over an area corresponding to the open area of the flask.

8. The system of claim 5 wherein said prefilling means comprises a source of pressurized air, an air manifold for distributing the pressurized air uniformly over the top surface of the sand in the sand magazine when the magazine is positioned over the flask, and air vent means at the bottom of said sand manifold for exhausting the air after it has carried the sand through the sand manifold.

9. The system of claim 5 wherein said prefilling means is located in a stationary position above the mold flask.

10. A system for making foundry molds comprising the combination of a platen assembly including a platen having a top surface for supporting a mold pattern, and a ram for raising and lowering the platen in response to a controllable pressurized fluid, a mold flask supported above said platen so that upward movement of the platen positions the mold pattern thereon within the flask and closes the bottom of the flask so that the flask and the platen assembly form a mold-forming cavity that can be filled with sand, a strip ring mounted on said ram and extending upwardly between said flask and said platen to form a portion of the bottom of the mold-forming cavity, and means for raising and lowering said strip ring relative to said ram and platen for drawing a mold formed in said cavity away from the pattern on said platen.

11. A system for making foundry molds comprising the combination of a platen assembly including a platen having a top surface for supporting a mold patteren, and a ram for raising and lowering the platen in response to a controllable pressurized fluid, a mold flask supported above said platen so that upward movement of the platen positions the mold pattern thereon within the flask and closes the bottom of the flask so that the flask and the platen assembly form a mold-forming cavity that can be filled with sand, a strip ring mounted on said ram and extending upwardly between said flask and said platen to form a portion of the bottom of the mold-forming cavity, means for raising and lowering said strip ring relative to said ram and platen for drawing a mold formed in said cavity away from the pattern on said platen, a sand magazine mounted for lateral movement between a retracted position where the magazine can be loaded with sand, and an advanced position above the mold flask where the cavity defined by the flask and the platen assembly can be filled with sand from the magazine, and pre-filling means for supplying pressurized air to the top of the sand magazine to quickly discharge sand from the magazine into the mold flask.

* * * * *